United States Patent [19]
Hunt, III
[11] 4,199,803
[45] Apr. 22, 1980

[54] MERCURY VAPOR FLOODLIGHT FIXTURE ASSEMBLY AND METHOD

[75] Inventor: Rector S. Hunt, III, Burlington, N.C.

[73] Assignee: Handy Man Electric Company, Burlington, N.C.

[21] Appl. No.: 899,243

[22] Filed: Apr. 24, 1978

[51] Int. Cl.[2] ..... F21K 7/00
[52] U.S. Cl. ..... 362/263; 362/20; 362/145; 362/147; 362/396; 362/406
[58] Field of Search ..... 362/20, 95, 145, 147, 362/8, 150, 247, 254, 314, 365, 370, 396, 399, 404, 406, 408, 263

[56] References Cited

U.S. PATENT DOCUMENTS

| | | | |
|---|---|---|---|
| 1,160,345 | 11/1915 | Wakefield | 362/408 |
| 1,834,795 | 12/1931 | Morse | 362/404 X |
| 2,007,528 | 7/1935 | Graham | 362/408 X |
| 3,048,833 | 8/1962 | Bernheim | 362/431 |
| 3,919,459 | 11/1975 | Van Steen | 362/368 |
| 4,149,230 | 4/1979 | Garchinsky | 362/396 X |
| 4,156,272 | 5/1979 | Wandler | 362/365 X |
| 4,156,902 | 5/1979 | Wandler | 362/307 |

*Primary Examiner*—Peter A. Nelson
*Attorney, Agent, or Firm*—B. B. Olive

[57] ABSTRACT

Disclosed is a mercury floodlight fixture assembly and method adapted for being mounted on a conventional outlet box as an improved replacement for an incandescent-type floodlight assembly. A novel bracket and hook member are used to support the relatively heavy ballast housing during installation after which the hook member is removed and the bracket member is utilized to support the housing.

2 Claims, 4 Drawing Figures

MERCURY VAPOR FLOODLIGHT FIXTURE ASSEMBLY AND METHOD

BACKGROUND OF THE INVENTION

1. Field of the Invention

The invention relates to mercury vapor floodlight fixture assemblies and their method of installation.

2. Description of the Prior Art

Incandescent and mercury vapor outdoor floodlight lighting equipment is well known. Mercury vapor lighting equipment is generally less expensive to operate and therefore from this viewpoint it is desirable to replace incandescent fixtures with mercury vapor fixtures. Floodlight fixtures are usually positioned in the eaves of homes or buildings and often at considerable height above the ground. Such elevation requires that the installer use a ladder to reach the fixture location. Mercury vapor fixtures typically require a ballast and due to this weight are difficult to install in such hard to reach locations. It has been a problem to position and connect the necessary wiring while supporting the fixture while standing on a ladder at some height. More specifically, there has not been available a mercury vapor lamp fixture assembly and a method of installation which allows the ballast weight to be supported during initial wiring connections.

SUMMARY OF THE INVENTION

The present invention provides a mercury vapor floodlight fixture assembly and method for installing the assembly in a standard outlet box. In the case of existing incandescent floodlight fixtures, the old fixture is removed leaving the outlet box exposed. An adapter bracket is secured to the existing outlet box and the supply wiring is fed from the outlet box through the bracket. A double-ended hook member is removably mounted on the bracket member and dangles downwardly therefrom and from which a photocell equipped, ballast containing and lamp mounting housing can be suspended during wiring. The wiring extending from the housing is next connected to the existing outlet box wiring while the fixture housing is supported by the hook member. This is especially advantageous since the electrician or other installer has both hands free with which to work and maintain his position on the ladder. The mentioned bracket is designed to accept the housing and once the wiring is properly connected, the hook member is removed and the housing is positioned and secured on the bracket member by mating pin and screw means associated therewith.

DESCRIPTION OF THE PREFERRED EMBODIMENT

Figure 1:
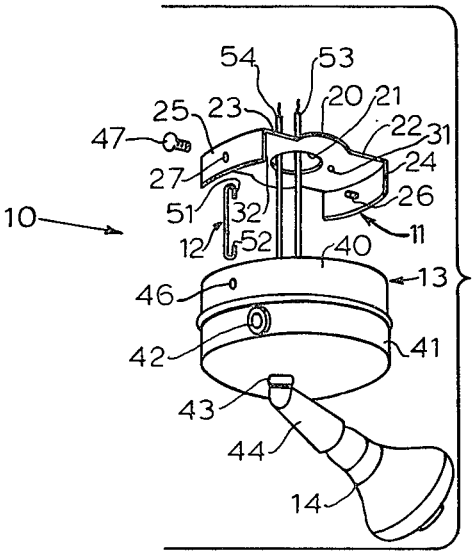
FIG. 1 is an exploded perspective view of the mercury vapor floodlight fixture assembly of the present invention.

Referring to the drawings, the mercury vapor floodlight fixture assembly 10 of the present invention comprises an adapter bracket 11, a hook member 12, a ballast, photocell and lamp mounting housing 13 and a mercury vapor lamp 14.

Figure 2:
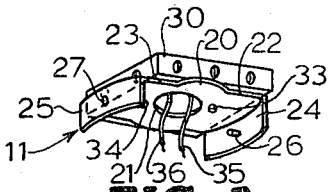
FIG. 2 is a perspective view illustrating the adapter bracket installed on an existing outlet box.

Adapter bracket 11 has a flat base plate portion 20 which has a central hole 21 punched therein through which the outlet supply wiring may be fed. Extensions 22, 23 extend outwardly from base plate 20 and at their extremeties have flanges 24, 25 which, as normally positioned, are turned vertically downward. Flange 24 has an integral pin 26 extending inwardly and horizontally therefrom and flange 25 has a threaded hole 27. Adapter bracket 11 is designed to mount directly on a conventional outlet box 30. For this purpose, holes 31, 32 of bracket 11 receive a pair of screws 33, 34 which fixedly secure bracket 11 to the usual threaded tabs, not shown, on box 30. The outlet supply wires 35, 36 are fed from box 30 through bracket hole 21. FIG. 2 is illustrative of how bracket 11 appears as mounted on outlet box 30.

Housing 13 encloses the relatively heavy ballast, not shown, mounts photoelectric cell 42 and socket 44 and is composed of a top housing portion 40 and a bottom housing portion 41. Top housing portion 40 overlaps and is rigidly secured to bottom housing portion 41. The photoelectric cell 42 is mounted within housing 13 and extends through bottom housing portion 41. Appropriate photocell circuitry is employed but is not shown. A swivel base 43 is also made integral with bottom housing portion 41 and mounts, in a swivel relation, lamp socket 44 which in turn receives lamp 14. Swivel base 43 allows lamp socket 44 and lamp 14 to turn 360° to aim the light from lamp 14 where the electrician or other installer wishes for it to project. Top housing portion 40 has a pair of holes 45, 46 which extend through this housing portion and which are designed to function in cooperation with pin 26 and a threaded thumb screw 47 respectively.

Figure 3:
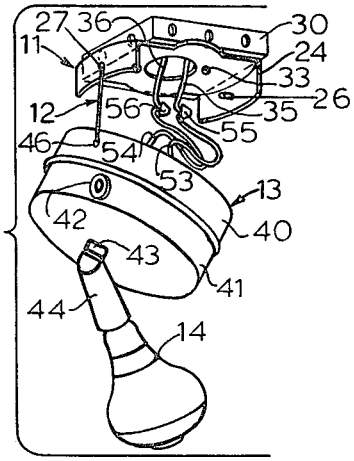
FIG. 3 is a perspective view illustrating the fixture assembly being suspended by the hook member with appropriate wiring connections made.
Figure 4:
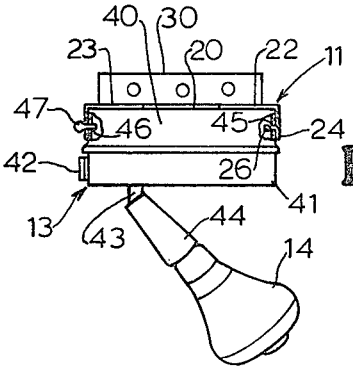
FIG. 4 is a side elevation partial section view of the fixture assembly completely installed.

A temporary double-ended hook member 12 has a pair of curved hook ends 51, 52 which are adapted to function in cooperation with threaded hole 27 of bracket 11 and with threaded hole 46 of top housing portion 40 of housing 13. As best illustrated in FIG. 3, housing 13 is suspended from bracket 11 by means of hook member 12 once curved end 51 is passed through hole 27 and curved end 52 is passed through hole 46. With housing 13 so suspended, the set of fixture wires 53, 54 extending from housing 13 are easily connected to the set of supply wires 35, 36 of outlet box 30 by twisting the wires together and securing the connection with insulating wire nuts 55, 56. Once the wiring is completed, housing 13 is now ready for being secured to bracket 11 with which housing 13 mates. This is accomplished by removing hook member 12 and positioning housing 13 so that hole 45 aligns with pin 26 of bracket 11. Once pin 26 is received by hole 45 of housing 13, housing 13 is now raised into place so that hole 46 of housing 13 aligns with threaded hole 27 of bracket 11. Here it will be noticed that the circular, pan-shaped housing 13 is designed to fit between flanges 24, 25 and below base plate 20 of bracket 11. Threaded thumb screw 47 is now threaded into hole 27 and passes through hole 46 in housing 13 which, with the aid of pin 26, provides support for housing 13.

In summary, the fixture assembly and method of the present invention provides a simple, reliable and safe way of installing a mercury vapor floodlight fixture particularly when such fixture is to be installed at a great height. Heretofore, as far as applicant is aware, there has been no way of supporting the new mercury vapor fixture other than by the installer who actually needed both hands to connect the wiring and maintain his balance on the ladder. To this end, applicant has introduced his improved and energy saving fixture assembly and method as described.

What is claimed is:

1. A mercury vapor floodlight fixture assembly comprising:

(a) an adapter bracket, said adapter bracket adapted to be secured to a conventional outlet box having electrical supply wires terminating therein, said bracket having a normally horizontally positioned flat base plate with a pair of normally vertically positioned downwardly extending opposed flange members appended thereto, one of said flange members having an aperture for receiving a threaded screw member therein and the other flange member having on the inner surface thereof a pin extending inwardly therefrom parallel to the plane of said base plate;

(b) a housing, said housing being adapted to fit between said flange members and to be secured on said bracket base plate, said housing having a pair of fitted top and bottom pan portions adapted for enclosing and mounting ballast photoelectric cell means associated with said fixture, said housing having a normally vertically positioned wall portion fitted with opposed pin receiving and threaded screw receiving apertures adapted to mate with said flange aperture and pin;

(c) a threaded screw member adapted to screw through said flange member having said aperture into said housing threaded aperture to support one side of said housing with the opposite side thereof being adapted for support by means of said flange pin being loosely inserted into said housing pin receiving aperture; and (d) a hook member comprising a rod having opposed inwardly oriented U-shaped end portions, one of said end portions being adapted to fit into said threaded flange aperture and the other of said end portions being adapted to fit into said threaded aperture of said housing, said hook member thereby being adapted to provide temporary support for said housing when said U-shaped end portions are so positioned in the said apertures.

2. The method of establishing a mercury floodlight on a conventional outlet box having a set of electrical supply lines terminating therein and threaded tab means for securing an appropriate light fixture thereto, comprising the steps of:

A. assembling at the site of the outlet the following components;

(1) a preformed bracket member having a central base plate adapted to be secured to said outlet tabs and to extend horizontally outwardly on two sides of said outlet box and with a central aperture through which said electrical supply lines can be fed and having a pair of opposed flanges extending outwardly and downwardly at the ends of said base plate with one of said flanges having an inwardly extending pin parallel to said base plate portion and the other of said flanges having a threaded aperture;

(2) a mercury vapor flood light fixture housing including:

(a) associated ballast means enclosed therein;

(b) a set of electrical lines for powering said fixture and extending therefrom;

(c) a mercury lamp socket on a bottom surface thereof; and (d) opposed sides apertures one of which is adapted to mate with said bracket flange threaded aperture and the other of which is adapted to mate with and receive said pin;

(3) a double ended hook member adapted for having one end releasably hooked in said bracket flange aperture and the other in said fixture housing aperture;

(4) insulator means for insulating connections between said sets of outlet box and fixture electrical lines; and B. installing and securing said bracket base plate horizontally to said threaded outlet box fixture threaded tab means and with said flanges extending vertically downwardly therefrom;

C. hooking one end of said hook member in said bracket flange aperture and hooking the other end of said hook member in one of said fixture housing apertures enabling the weight of said housing and said enclosed ballast to be suspended from said bracket through said hook member;

D. connecting, and insulating such connections with said insulator means, said sets of outlet box and fixture housing electrical lines;

E. positioning said connections within said outlet box above said base plate;

F. removing said hook member;

G. locating said housing with said pin in one said housing aperture and the opposed housing threaded aperture mated to the opposite flange threaded aperture; and H. installing said screw means in said flange and housing apertures to fix said housing on said bracket with said socket adapted for receiving an appropriate mercury vapor lamp therein.

* * * * *